United States Patent [19]

Lovingood

[11] 4,223,744

[45] Sep. 23, 1980

[54] REVERSING HAMMER DRILL

[75] Inventor: James L. Lovingood, Pickens, S.C.

[73] Assignee: The Singer Company, Stamford, Conn.

[21] Appl. No.: 930,776

[22] Filed: Aug. 3, 1978

[51] Int. Cl.[3] ..... E02D 7/02

[52] U.S. Cl. ..... 173/48; 307/115; 318/245; 318/289

[58] Field of Search ..... 307/113, 115; 310/68 A; 318/289, 293, 245, 739; 173/47, 48

[56] References Cited

U.S. PATENT DOCUMENTS

| | | | |
|---|---|---|---|
| 2,072,551 | 3/1937 | Forss | 171/252 |
| 3,147,423 | 9/1964 | Du Rocher | 307/115 X |
| 3,260,827 | 7/1966 | Frenzel | 200/157 |
| 3,789,933 | 2/1974 | Jarecki | 173/48 |
| 3,802,518 | 4/1974 | Albert | 173/29 |
| 3,809,168 | 5/1974 | Fromm | 173/48 X |
| 4,145,640 | 3/1979 | Kipp et al. | 318/293 X |

FOREIGN PATENT DOCUMENTS

| | | | |
|---|---|---|---|
| 1366572 | 9/1974 | United Kingdom | 173/48 |

*Primary Examiner*—Wm. Carter Reynolds
*Attorney, Agent, or Firm*—Edward L. Bell; Robert E. Smith; Elliot A. Lackenbach

[57] ABSTRACT

A hammer drill having a bypass switch which is activated by the selector ring to prevent the drill from operating in the hammer mode by shunting the reversing switch. This is a precaution to prevent damage to the clutch teeth which are designed for ratchet action when the tool is operated in the forward direction, but will lock down in reverse to stall tool or damage the mechanism. In the drill mode, the bypass switch connects the reversing switch in circuit with the on-off switch.

5 Claims, 4 Drawing Figures

REVERSING HAMMER DRILL

BACKGROUND OF THE INVENTION

In the prior art, hammer drills originally had only forwardly rotated motors and therefore the hammering mechanisms could operate at will whenever the selector was set for the hammer mode. However, with the use of reversing switches, which are desirable for the drilling operation, it became necessary to instruct the operator not to use reverse during hammering. Such a warning is not a solution, but unfortunately the operator had no restraint against operating the tool in reverse during hammering. Manual biasing means present a partial solution, but can be defeated by an operator's manual override.

SUMMARY OF THE INVENTION

It is an object of the present invention to provide an improved reversing hammer drill which overcomes the prior art disadvantages; which provides a bypass switch for forward motor operation in the hammer mode; which has a DPDT bypass switch in circuit with the trigger switch and reversing switch; which permits forward or reverse drilling, but prevents reverse hammering; which adds a bypass switch to prevent damage to the hammering mechanism, and which uses a bypass switch selectively to shunt the reversing switch.

Other objects and advantages will be apparent from the following description of the invention and the novel features will be particularly pointed out hereinafter in the claims.

BRIEF DESCRIPTION OF THE DRAWINGS

This invention is illustrated in the accompanying drawings in which.

DESCRIPTION OF THE INVENTION

Figures 1, 2:
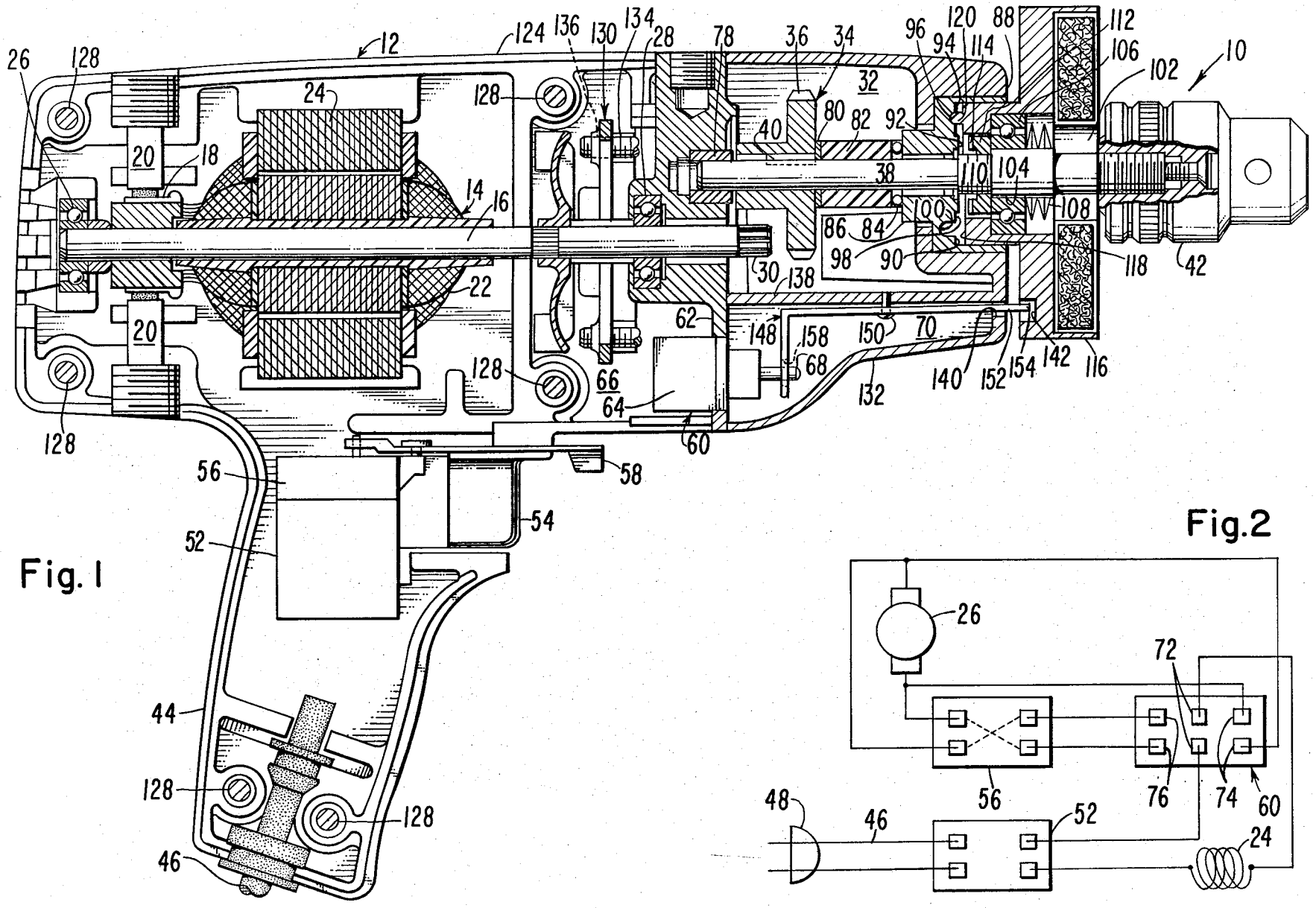
FIG. 1 is a side elevational view of a hammer drill embodying the present invention.
FIG. 2 is a schematic diagram of the electric circuit of the hammer drill.

In the illustrated embodiment of the invention, a hammer drill, designated generally 10, is shown in FIG. 1, and has a housing 12 in which is journaled a universal motor 14 having an armature shaft 16 which carries a commutator 18, engaged by a brush assembly 20. An armature 22 is affixed to the shaft 16, and a stator field 24 is disposed thereabout. The armature shaft 16 is journaled by a pair of spaced bearings 26 and 28, and has a drive pinion 30 extending into a gear chamber 32 to drive a gear train 34. The last gear of the train 34 is a spindle gear 36 which is affixed to a spindle shaft 38 by a key 40. The spindle 38 extends externally of the housing 12 and has affixed thereto a chuck 42 to which a suitable tool bit (not shown) will be connected to engage the work. The housing 12 has a pistol grip handle 44, the lower end of which receives an electric cord 46 the end of which has a plug 48 shown in FIG. 2 adapted to be connected to a suitable source of electric power. The cord 46 is in circuit with switch assembly 50 including a trigger switch 52 actuated by a trigger 54, and a rotation reversing switch 56 affixed atop the trigger switch 52 and actuated by a pivotal lever 58. A bypass switch 60 is also included in the switch assembly 50 and is mounted in the housing 12 below the front bearing 28 in the wall 62 with the switch body 64 disposed in the motor chamber 66 and the switch toggle 68 extending into a bypass switch chamber 70 formed below the gear chamber 32.

FIG. 2 is a schematic diagram for the hammer drill 10 wherein the motor 14 and its armature 22 and field 24 has its on-off condition controlled by the trigger switch 52. The bypass switch 60 is preferably a double pole-double throw (DPDT) switch with its center contacts 72,72 in circuit with the trigger switch 52. When the right contacts 74,74, as viewed in FIG. 2, are connected to the center contacts 72,72, as they will be in the hammer mode as explained more fully hereinafter, the armature 26 and consequently the motor 14 will be rotated in the forwardly direction. By connecting contacts 72 and 74, the reversing switch 56 is shunted from the circuit. Therefore, even if the reversing switch is manually positioned in the reverse setting, it will have no effect upon the circuit operation. When the tool 10 is placed in the drill mode, the bypass switch will have the left contacts 76,76, as viewed in FIG. 2, engaged with contacts 72,72 to place the reversing switch 56 in circuit so as to permit the operator to select forward or reverse rotation of the motor 14. A suitable speed control device (not shown) for controlling the motor 14 speed can be included in circuit integrally connected to or separate from the trigger switch 52, as desired.

Figure 4:
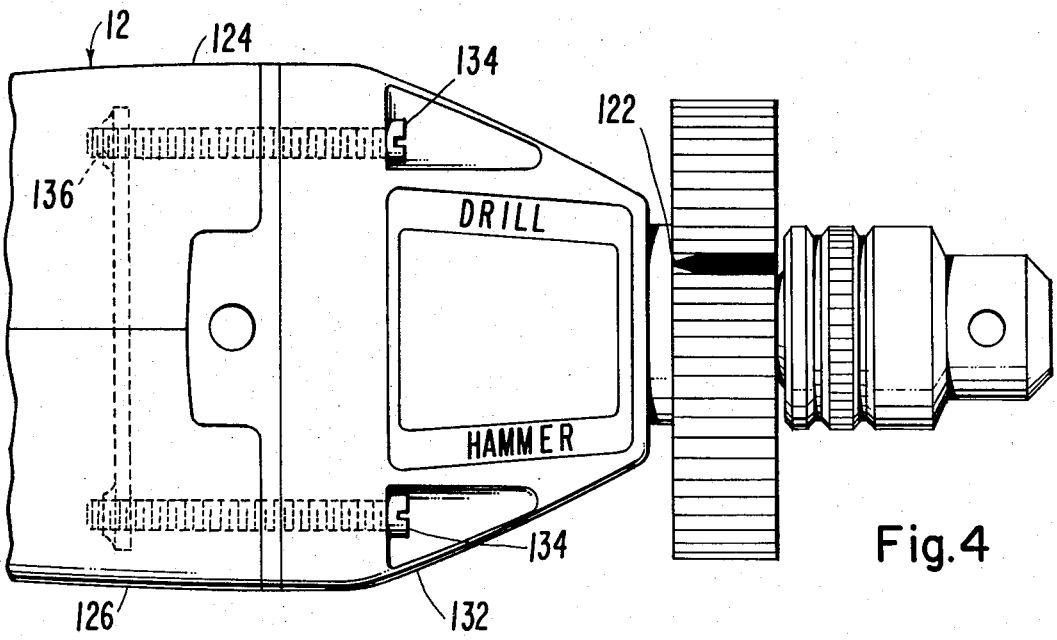
FIG. 4 is a top plan view, partly broken away and in section, of the front end of the hammer drill showing the selector in the drill setting.

The spindle 38 illustrated in FIG. 1 has a limited axial movement within a sleeve bearing 78 so that the spindle may be axially shifted between the drill and the hammer positions, and also is free to be axially shifted to partake of the hammering ratchet action during the hammer mode of operation. A washer 80, spacer 82 and thrust bearing 84 are disposed about the spindle 38 forwardly of the spindle gear 36 to abut a stationary ratchet 86 affixed within the nose 88 of the housing 12. The ratchet 86 has a front face 90 fitted with annular angular teeth 92 in spaced relationship to the spindle 38, and radially outwardly thereof is a first aligned drill set surface 94 with holding dimple 96, and a second axially set-back hammering set surface 98 with holding dimple 100. A spindle collar 102 has the chuck 42 abut its outer end, and a journal section 104 is formed inwardly, or as viewed in FIG. 1, on the left side of the collar 102. A ball bearing 106 journals the section 104 at its inner end, with a plurality of spring washers 108 disposed between the collar 102 and the bearing 106. A threaded section 110 having left hand threads is formed on the left side of the journal section 104 at a slightly reduced diameter. An annular clutch 112 is connected upon the threaded section 110 to abut the inner race of the bearing 106. Angular teeth 114 face the anular teeth 92 of the ratchet and in the drill setting shown in FIGS. 1 and 4 are held in spaced relationship therewith so that the spindle 38 will only rotate. A set or selector ring 116 is turnably fitted within the stationary ratchet 86 with its enlarged inner end abutting the inner face of the outer race of the bearing 106. The inner or leftward edge 118 has a small projection 120 which will fit within to be yieldably held in one or the other of the dimples 96 or 100. Whenever the operator desires to change the mode of operation from that of drill to that of hammer, the ring 116 will be turned to remove the projection 120 from engagement within drill dimple 96 as shown in FIG. 1 to cause the projection 120 to engage the hammer dimple 100 which will produce a slight inward axial shifting of the ring 116 and spindle 38 to abut the corresponding clutch teeth 114 with the ratchet teeth 92. This change is mode of operation will be visually shown by the indicator 122, illustrated in FIG. 4, being shifted from its alignment with the "drill" marking to that of the "hammer" marking. The corresponding teeth 92 and 114 are angled to rotate forwardly to produce the ratcheting or hammering effect. The engaged teeth continuously ride over and fall to produce the back and forth axially shifting or "hammering". The forward rotational direction is assumed to be rightward or clockwise rotation. The reverse rotational direction is assumed to be leftward or counterclockwise rotation.

In the event the operator were able to accidentally set the reversing switch 56 to reverse and the ring 116 to hammer, the sets of teeth 92 and 114 would lock down against each other. This would either stall the motor 14 which might cause it to burn out, or the clutch 112 could be unthreaded from the left hand threads of the section 110 of the spindle 38, or the teeth or other parts of the mechanism could be damaged.

It is the principal purpose of the present invention to eliminate the possibility of the operator being able to place the hammer drill 10 in the reverse mode of operation whenever the indicator 122 is set for the hammer operation. This is done by the bypass switch 60 shunting the reversing switch 56 upon the selector ring 116 being set for "hammer", and restoring the switch 56 in circuit when the ring 116 is again set for "drill".

The housing 12 shown in FIG. 1 has the motor chamber 66 which is made up of two clamshell portions 124, 126 (see FIGS. 3 and 4) interconnected to each other by screws 128. A strip nut 130 is disposed into aligned recesses formed within each of the clamshell portions 124, 126 so that, upon the motor section being assembled, the strip nut 130 will be locked in position therein. A head section 132 in which the gear chamber 32 is formed carries the gear train 34 and the chuck 42. The head section 132 is connected to the assembled clamshell portions 124, 126 via long screws 134, illustrated in FIGS. 3 and 4, being threadedly received in tapped holes 136 of the strip nut 130.

Figure 3:
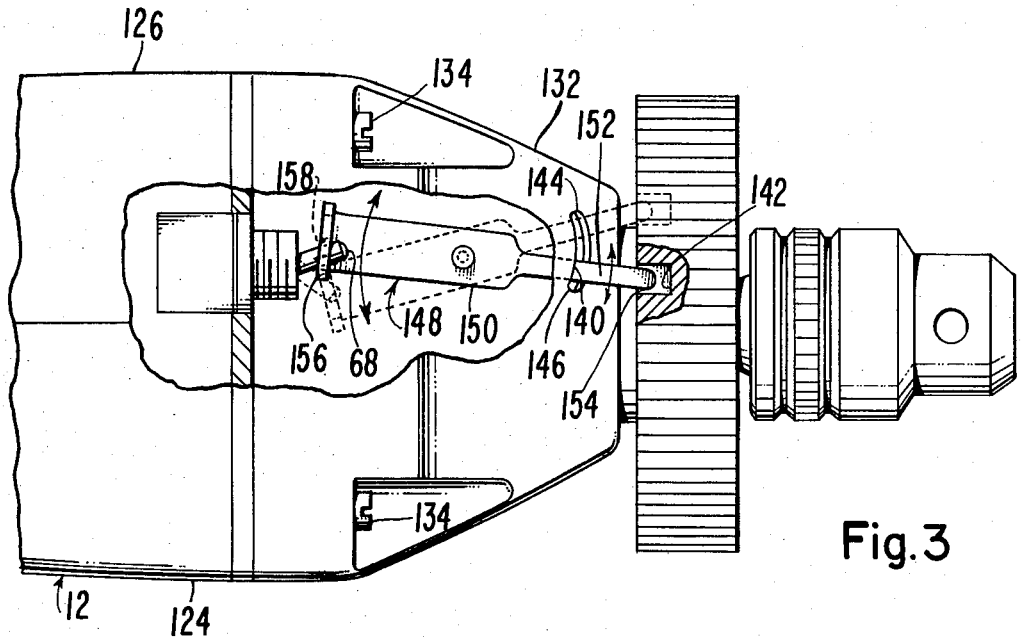
FIG. 3 is a bottom view, partly broken away and in section, of the front end of the hammer drill showing the bypass switch and lever mechanism which operates the same.

A partition 138 shown in FIG. 1 separates the gear chamber 32 from the bypass switch chamber 70. An aperture 140, illustrated in FIGS. 1 and 3, is formed at the nose 88 end of chamber 70 below the partition 138 and extends substantially horizontal. The selector ring 116 has a narrow recess 142 in alignment with the aperture 140 so that when the ring 116 is placed in the drill setting shown in FIG. 4, the recess 142 will be positioned adjacent the top edge 144 as indicated by the dotted line representation of the recess 142 illustrated in FIG. 3. Shifting of the selector ring 116 to set it by hammer will, if viewed from the front of the hammer drill looking toward the chuck 42, require a counterclockwise motion of the ring 116 that will result in the recess 142 being placed opposite the bottom edge 146 as shown in the solid line representation of FIG. 3.

A lever 148 illustrated in FIGS. 1 and 3 is pivotally connected to the underside of the partition 138 by a rivet 150. The forward end 152 of the lever 148 exits the chamber 70 through the horizontal aperture 140 and its tip 154 enters the recess 142 which is longer than it is wide so that any slight shifting thereof responsive to rotation of the selector ring 116 will cause the tip 154 to engage the walls of the recess 142 and be shifted thereby. The rear portion of the lever 148 has a leg 156 which turns downwardly at a right angle above the toggle 68 so that a slot 158 formed near its lower end will entrap the toggle 68 therein and cause it to shift in the opposite direction as that of the tip 154. The operative positions of the bypass switch 60 are shown in FIG. 3 in which the solid line representation of the toggle 68 is in the upper position and lever 148 is slanted downwardly towards the right which corresponds to the hammer mode of operation wherein the switch 60, contacts 72 and 74 illustrated in FIG. 2 are connected to shunt the reversing switch 56 so that motor 14 can rotate only in the forward direction. When the selector ring 116 is shifted from hammer to drill, which is the FIG. 4 setting with the indicator 122 opposite the drill rotation, the bypass switch 60 will be switched to the dotted line representation shown in FIG. 3 in which the toggle 68 is in the lowered position and the lever 148 slanted upwardly towards the right. In the drill set position, the bypass switch 60 will connect contacts 72 and 76 illustrated in FIG. 2, to place the reversing switch 56 in circuit to control whether the motor 14 is rotated in the forward or reverse rotational direction.

It will be understood that various changes in the details, materials, arrangements of parts and operating conditions which have been herein described and illustrated in order to explain the nature of the invention may be made by those skilled in the art within the principles and scope of the invention.

Having thus set forth the nature of the invention what is claimed herein is:

1. A bypass switch assembly for a reversing hammer drill comprising:

a. a housing,
b. a motor journaled in the housing,
c. a hammer drill mechanism selectively operable as a drill or as a hammer drill,
d. a trigger switch in circuit with the motor to turn the motor on and off,
e. a reversing switch adapted to set the motor for rotation in the forward or reverse direction, and
f. a bypass switch in circuit between the motor and the trigger switch selectively to connect the reversing switch in circuit with the motor or to shunt the reversing switch.

2. The combination claimed in claim 1 wherein:

a. the bypass switch defines a double pole - double throw (DPDT) switch.

3. The combination claimed in claim 1 wherein:

a. a selector ring shiftably connected to the housing, and to set the hammer drill mechanism by shifting between a drill setting or a hammer setting, and
b. a mechanical interlink between the selector ring and the bypass switch whereby the shifting of the ring will switch the bypass switch.

4. The combination claimed in claim 3 wherein:

a. the mechanical interlink defines a lever pivotally connected in the housing,
b. the lever has one end engaging the selector ring, and the other end engaging the bypass switch whereby the shifting motion of the selector ring is transmitted to the bypass switch to switch the same.

5. The combination claimed in claim 4 wherein:

a. a bypass switch chamber formed in the housing,
b. the bypass switch disposed in the chamber, c. the lever pivotally connected to one wall of the chamber,
d. one end of the lever engaging the bypass switch within the chamber,
e. the selector ring disposed adjacent to and external of the chamber, and
f. the other end of the lever exiting the chamber to engage the ring and to be shifted responsive to the shifting of the ring whereby the bypass will selectively shunt the reversing switch or connect it in circuit with the motor.

* * * * *